US005094462A

United States Patent [19]

Boyle et al.

[11] Patent Number: 5,094,462

[45] Date of Patent: Mar. 10, 1992

[54] SOCCER TRAINING DEVICE

[76] Inventors: Matthew D. Boyle, 68 Myrray Ave.; Fuller H. Brooks; Barbara L. George, both of 268 Main St., all of Goshen, N.Y. 10924

[21] Appl. No.: 633,011

[22] Filed: Dec. 24, 1990

[51] Int. Cl.[5] ..... A63B 69/06

[52] U.S. Cl. ..... 273/414

[58] Field of Search ..... 273/413, 414, 58 C, 273/DIG. 30, 200 R, 26 E

[56] References Cited

U.S. PATENT DOCUMENTS

| | | | |
|---|---|---|---|
| 1,608,849 | 11/1926 | Gilmour | 273/413 |
| 3,542,364 | 11/1970 | Gaumond | 273/DIG. 30 |
| 3,940,133 | 2/1976 | Civita | 273/58 C |
| 4,022,476 | 5/1977 | Barton | 273/200 R X |
| 4,042,241 | 8/1977 | Collins | 273/414 X |
| 4,147,353 | 4/1979 | Moore | 273/58 C X |
| 4,687,209 | 8/1987 | Carey | 273/414 X |
| 4,881,742 | 11/1989 | Hargreave | 273/413 |

FOREIGN PATENT DOCUMENTS

| | | | |
|---|---|---|---|
| 2069344 | 8/1981 | United Kingdom | 273/58 C |
| 2107995 | 5/1983 | United Kingdom | 273/414 |

*Primary Examiner*—Paul E. Shapiro
*Attorney, Agent, or Firm*—Marvin S. Gittes

[57] ABSTRACT

A soccer training device including a soccer ball located within a net. The net is attached to one end of a bungee cord and the other end of the bungee cord is attached to a strap which is placed about a person's wrist or ankle. The person kicks the ball within the net and by having the strap fastened to his limb the ball is propelled away from the person and then returned to his vicinity allowing the person to play soccer by himself.

2 Claims, 1 Drawing Sheet

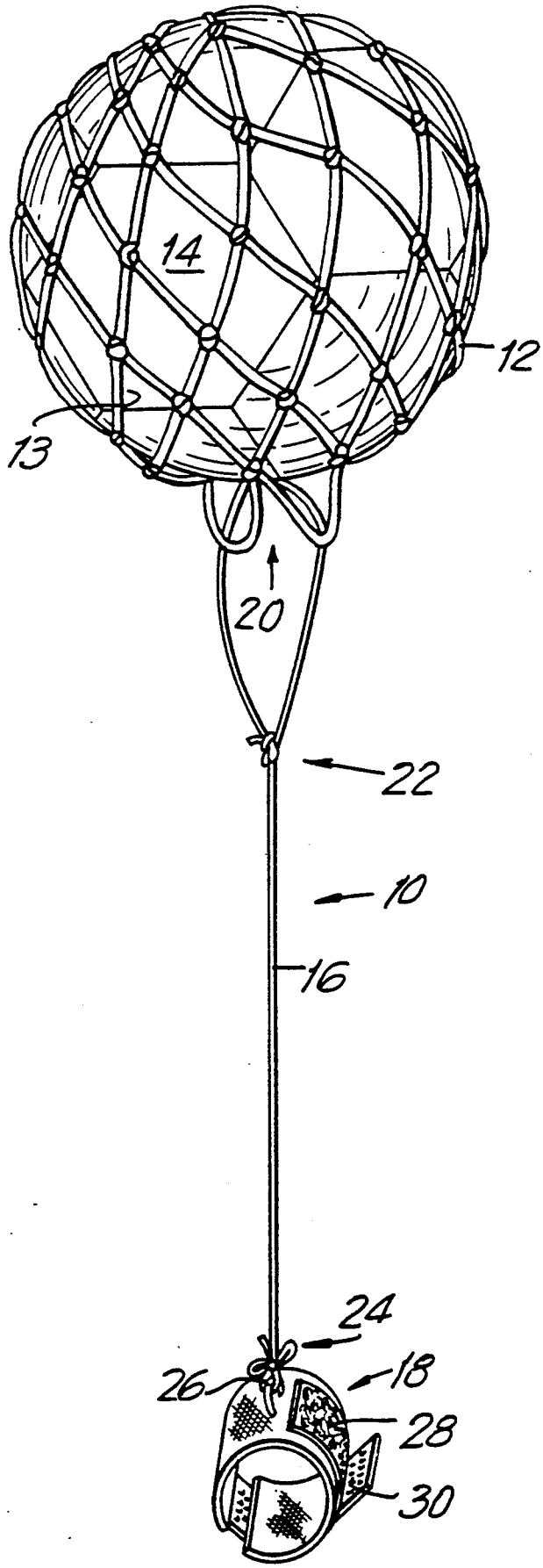
14
12
13
20
22
10
16
24
26
18
28
30

SOCCER TRAINING DEVICE

BACKGROUND OF THE INVENTION

1. Field of the Invention

Apparatus to enable a person to play soccer by himself.

2. Brief Description of the Prior Art

In the last several years soccer has become more and more popular as a competitive sport in the United States. Part of this can be attributed to the fact that soccer, unlike American football, does not require extensive and expensive protective equipment and also because soccer can be played and excelled at by persons of all sizes.

To play soccer, one must, in addition to being in excellent physical condition, have excellent coordination and the ability to instantaneously react with respect to a moving soccer ball so as to be able to anticipate the motion of the soccer ball, kick the ball, or take other appropriate action. In order to improve a players skills in soccer, it is necessary to improve the players reflexes so that he will be able to react in as short a time as possible to a moving soccer ball and respond accordingly.

Obviously, the best technique for improving one's skills as a soccer player is to practice and play with other players as much as possible. Sometimes this is not possible because there are no other players available to practice and play soccer with or because there is no field available or due to inclement weather, etc.

There have been patents which have issued which disclose inventions designed to enable a person to practice and hone those skills necessary to play a particular sport.

U.S. Pat. No. 3,042,404 which issued on July 3, 1962 to George R. Masters is for an invention entitled "Football Practice Gear". Mr. Masters, in his patent, discloses a fabric headband 14 which is wrapped around a person's head. Attached to said fabric headband is an elastic tether 10 with the remaining end of the elastic tether attached to a loop which is affixed to a football. Mr. Masters' invention is intended to be used so that a person who has placed the headband on his head may throw the football and the tether will return the ball to the player as a result of its elasticity. The "Football Practice Gear" of the Masters patent has several drawbacks in that it requires a specially designed football and also can be dangerous in that when the football is returned, as a result of the elasticity in the tether, there is always the danger of the person wearing the headband being injured.

U.S. Pat. No. 4,350,338 which issued on Sept. 21, 1982 to Randall L. May discloses a "Football Practice Aid". The "Football Practice Aid" consists of a football, a steel and nylon harness, a series of metal attachments that allow complete rotation and movement of the football, a tether rope, a small elastic tether cord and a means connecting a stake in the ground. The patent to Mr. May is described as having the purpose of enabling one to practice kicking and passing a football with the football always returning to its point of origin, a fixed location, through the use of the elastic cord.

U.S. Pat. No. 660,787 which issued to Bissell on Oct. 30, 1900 discloses a ball surrounded by a holder 3 made of fibrous material. The ball and cover of fibrous material is attached to a tether so that after being hit it will be returned to its original location.

U.S. Pat. No. 4,352,497 to Warehime which issued on Oct. 5, 1982 discloses a mobile game having play goals in the form of tether balls with various heights of tether anchors.

U.S. Pat. No. 1,782,254 to Breidenbach which issued on Nov. 18, 1930 discloses a ball secured by an elastic rope midway between two handles. The ball is moved from one end to the other by players at each of the two ends of the rope in an elaborate tug-of-war.

U.S. Pat. No. 3,351,343 to Papp dated Nov. 7, 1967 is directed to a tethering means for a game ball. Two woven nylon bands snugly fit around surface portions of a ball and are attached to a flexible tether element.

The several prior art patents listed above do not disclose a soccer ball training aid which is capable of being attached to a portion of a person's body via an elastic means such that the person may kick the soccer ball and when the soccer ball returns, the person can again kick the ball, etc.

SUMMARY OF THE INVENTION

One of the objects of the present invention is to provide new and improved structure to enable a person to play soccer by himself.

Still another object of the present invention is to provide a new and improved soccer device which is attached to a portion of a person's body whereby when the person kicks the soccer ball he can appropriately position himself to again kick the ball when it is returned to the vicinity of his body.

Still another object of the present invention is to provide an improved soccer training aid which can be attached to a person's foot or wrist and will automatically return a kicked soccer ball to the vicinity of the person so that he can again kick it.

Other objects of the invention will become apparent from time to time throughout the specification and claims as hereinafter related.

The foregoing objects are accomplished by having a soccer ball enclosed in a netting. A bungee cord (elastic cord) is provided and has one end attached to the netting and the other end to a strap device which can be temporarily secured to a person's wrist or ankle. The person will utilize the device by attaching the strap, as his personal preference may be, to either his wrist or ankle, and kick the ball. Because of the elasticity of the bungee cord, the ball will travel a certain distance away from the person and then return to the vicinity of the person. The person can then position himself to again kick the ball and this process can be repeated. By requiring the person to move in order to again kick the ball, this improves the person's coordination, reflexes and foot and eye coordination, all skills that are important for a competitive soccer player, or for that matter for a recreational soccer player. In addition, the person has the enjoyment of simulating the playing of soccer.

BRIEF DESCRIPTION OF THE FIGURE

The FIGURE is a prospective view of an embodiment of the present invention.

DETAILED DESCRIPTION OF THE PREFERRED EMBODIMENT

In the drawings a preferred embodiment 10, according to the present invention, is shown and includes a net 12 within which is located a soccer ball 14, a bungee cord or other elastic cord 16 and a wrist and/or ankle strap 18.

Net 12 may be made from a nylon material, such as is used in a basketball net and has an open end 20 for a purpose to be hereinafter described. Generally the material which makes up net 12 will have several strands with various strands tied to each other at certain locations such that there will be a plurality of relatively small openings 13 via which one can look into the interior of the net.

Located within net 12 is a soccer ball 14 which can be conventional in design. The openings 13 are of a significantly smaller size than the diameter of soccer ball 14 so the soccer ball cannot pass through said openings. Net 12 includes an open end 20, which is the only means to insert and remove a soccer ball from the net interior. The portions of the net which define open end 20 can be pulled apart so that open end 20 defines an opening large enough to allow a soccer ball to pass therethrough into the interior of the net.

Bungee cord 16 includes a first end 22 and a second end 24. First end 22 has a knot formed thereat as a means of securing the bungee cord to the net. Normally this will be done by passing the free end of bungee cord 16 through opposite sides of net 12 which define the open end 20 and then tying the free end of bungee cord 16 to the bungee cord via a knot so that the open end 20 of net 12 is constricted from reaching a size large enough so that the soccer ball can be removed from the interior thereof.

The remaining end or second end 24 of bungee cord 16 is threaded through a loop 26 of strap 18 and then tied to itself so that the bungee cord is always attached to strap 18.

Strap 18 can be made of conventional cloth and have affixed thereto mating Velcro surfaces 28 and 30 on the exterior surface of one end of the strap and the interior surface of the other end. When surfaces 28 and 30 are brought in contact with each other, the Velcro hooks and loops are attached to each other so that the two ends of the strap are secured to each other forming an enclosure which may be placed about a person's wrist or ankle.

The use of the present invention will now be described. Soccer ball 14 will be placed inside net 12 through opening 20. The free end of bungee cord 16 will extend through opposite portions of the open end 20 of net 12 and be affixed to the remainder of the bungee cord as shown in the FIGURE. The other end of the bungee cord namely the second end 24 will be affixed to loop 26. The person using the present invention will, at his option, attach strap 18 to either his ankle or wrist.

Let us assume, for purposes of discussion, that strap 18 is affixed is the person's wrist. Strap 18 is wrapped around the person's wrist and with the two Velcro surfaces 28 and 30 attached to each other. By using two Velcro surfaces as described, the strap can be made to snugly fit about different size wrists or ankles.

The person will then kick the ball in the net, stretching the bungee cord such that its elastic limit will be reached. The elasticity in the bungee cord will then return the soccer ball in the net to the immediate vicinity of the person requiring the person to move so as to position himself to kick the soccer ball again. This cycle will be repeated enabling a person to play soccer by himself. To maintain the soccer ball in continuous motion, enhances a person's reflexes, his eye and foot coordination and improves those skills which are necessary to be a good soccer player. In addition, utilizing the present invention as just described is quite enjoyable.

Alternatively, strap 18 can be attached to a person's foot and the invention utilized by the person initially giving the soccer ball a kick. As the soccer ball is projected away from the person, tension develops on the bungee cord such that after a given period of time the elasticity in the bungee cord returns the soccer ball to the vicinity of the person's foot. At this time the person would kick the ball again and by appropriately positioning himself and kicking the ball one will try to keep the soccer ball continually in motion.

The length of bungee cord can be selectively varied so that at the player's choice the bungee cord length can be extended or shortened. The varying lengths of the bungee cord, when using the present invention, will provide different challenges to the user of the invention while at the same time improving the person's reflexes, eye/foot coordination and other skills utilized in playing soccer. Suggested lengths for the bungee cord are 2½ feet, 3 feet, 3½ feet, 4 feet, 4½ feet, 5 feet and 5½ feet. Various thicknesses of bungee cord can be used such as #4 or #5. The thickness of bungee cords selected will be a matter of choice and depends on the user's expertise.

While a bungee cord has been described in the context of attaching strap 18 to net 12, other elastic means can be used which will be apparent to those of ordinary skill in the art.

While this invention has been described fully and completely with special emphasis upon a single preferred embodiment, it should be understood that within the scope of the appended claims this invention may be practiced otherwise than as specifically described herein.

We claim:

1. An article for simulating the playing of soccer, comprising a soccer ball, a net surrounding said soccer ball, said net including several strands fastened to each other at certain locations such that there are a plurality of small openings via which one can look into the interior of the net, said openings being of a significantly smaller size than the diameter of the soccer ball so that the soccer ball cannot pass through said openings, said net including an open end through which a soccer ball can be inserted and removed from the net interior, means for allowing the open end of the net to be pulled apart to define an opening large enough to allow a soccer ball to pass therethrough into the interior of the net, an elastic means having a first end and a second end, said first end secured to said open end of said net to close the same by passing through opposite ends of the net which define the open end thereof and then being tied about the remainder of the elastic means so that the open end of the net is constricted in size to prevent the soccer ball contained in the interior thereof from being removed therefrom;

a strap for wrapping about and constricting a portion of a person's limb, said strap having on the exterior surface of one end thereof VELCRO fastening means and on the other end thereof, mating VELCRO fastening means such that the respective VELCRO fastening means can be attached to each other so as to constrict said strap about a person's limb, said second end of said elastic means being attached to said strap.

2. An article according to claim 1, wherein said elastic means is a bungee cord, said strap having on the exterior surface thereof a loop and the second end of the bungee cord being secured to said loop.

* * * * *